US006582275B1

(12) United States Patent
Lai

(10) Patent No.: US 6,582,275 B1
(45) Date of Patent: Jun. 24, 2003

(54) STRUCTURE FOR QUICKLY TURNING UP CAR SHELL OF A REMOTELY CONTROLLABLE CAR

(75) Inventor: Aling Lai, Taichung (TW)

(73) Assignee: Thunder Tiger Corporation, Taichung (TW)

( * ) Notice: Subject to any disclaimer, the term of this patent is extended or adjusted under 35 U.S.C. 154(b) by 0 days.

(21) Appl. No.: 10/201,033

(22) Filed: Jul. 23, 2002

(51) Int. Cl.[7] ..... A63H 17/00

(52) U.S. Cl. ..... 446/465; 446/466; 446/456; 446/470; 446/471

(58) Field of Search ..... 446/471, 470, 446/93, 94, 95, 96, 465, 454, 456, 466

(56) References Cited

U.S. PATENT DOCUMENTS 4,411,098 A * 10/1983 Birdsall et al. ..... 446/471
4,919,639 A * 4/1990 Hesse ..... 446/471
5,322,469 A * 6/1994 Tilbor ..... 446/454
5,482,494 A * 1/1996 Ishimoto ..... 446/456
5,785,576 A * 7/1998 Belton ..... 446/456
6,394,878 B1 * 5/2002 Wang ..... 446/454

* cited by examiner

*Primary Examiner*—Derris H. Banks
*Assistant Examiner*—Urszula M Cegielnik

(57) ABSTRACT

A structure for quickly turning up a car shell of a remotely controllable car, including two fixing boards connected with the car body for fixing the car shell. Each fixing board has a projecting column having a stop section at top end. The car shell is formed with a through hole for the column and the stop section to pass therethrough. A seat body is disposed on inner face of the car shell. A clip disposed on outer face of the car shell is connected with the seat body. The clip has a clip section and a press section. The clip section clips the column of the fixing board and is stopped by the stop section to fix the car shell. When turning up the car shell, the press section is compressed to stretch open the clip section and release the clip section from the stop of the stop section. Then the press section of the clip can be lifted to turn up the car shell.

10 Claims, 11 Drawing Sheets

STRUCTURE FOR QUICKLY TURNING UP CAR SHELL OF A REMOTELY CONTROLLABLE CAR

BACKGROUND OF THE INVENTION

A present invention is related to a structure for quickly turning up a car shell of a remotely controllable car. A clip is connected on the car shell. When pressing the clip, the clip can be simultaneously lifted to quickly turn up the car shell.

FIG. 11 shows a conventional fixing structure for a car body 80 and a car shell 83 of an existent remotely controllable car. Several fixing posts 81 are disposed on the car body 80. Each fixing post 81 is formed with several insertion holes 82. A fixing insertion pin 85 is inserted in one insertion hole 82 of the fixing post 81 at a certain height. In addition, the car shell 83 is formed with several locating holes 84 respectively corresponding to the fixing posts 81. The fixing posts 81 are fitted in the locating holes 84 and then a locating insertion pin 86 is inserted into another insertion hole 82 higher than the fixing insertion pin 85. Accordingly, the car shell 83 is located by the fixing insertion pins 85 and the locating insertion pins 86 inserted in the fixing posts 81 as shown in FIG. 12.

In use or in a race, it is often necessary to detach the car shell 83 for service, adjustment or fueling. In order to detach the car shell 83, a user needs to one by one extract the locating insertion pins 86. After the service, adjustment or fueling, the user must first aim the locating holes 84 at the fixing posts 81 and then fit the car shell 83 onto the fixing posts 81. Then the locating insertion pins 86 are one by one inserted into the insertion holes 82 of the fixing posts 81 to fix the car shell 83.

The car shell 83 is painted and is not transparent so that it is hard to accurately fit the fixing posts 81 into the locating holes 84 or fit a pole body through the car shell 83. Moreover, it is necessary for the user to carefully aim the locating insertion pins 86 at the insertion holes 82 of the fixing posts 81. Otherwise, the user can hardly insert the locating insertion pins 86 into the insertion holes 82. Accordingly, it is quite troublesome and time-consuming to detach and install the car shell 83. This will seriously affect the race. Moreover, under an urgent situation, the serviceman is often so nervous as to fail to accurately immediately insert the locating insertion pins 86 into the insertion holes 82 or even miss the locating insertion pins 86. As a result, the car shell 83 cannot be truly fixed on the car body 80.

SUMMARY OF THE INVENTION

It is therefore a primary object of the present invention to provide a structure for quickly turning up car shell of a remotely controllable car. A clip is connected with a seat body connected with the car shell. The car shell is fitted on a projecting column of a fixing board of the car body. A clip section of the clip clips the column and is stopped by a stop section thereof so as to fix the car shell on the fixing board. When pressing a press section of the clip, the clip section is stretched open and released from the stop of the stop section. At this time, a user can simultaneously lift the clip to quickly turn up or close the car shell.

The present invention can be best understood through the following description and accompanying drawings wherein:

DETAILED DESCRIPTION OF THE PREFERRED EMBODIMENTS

Figure 1:
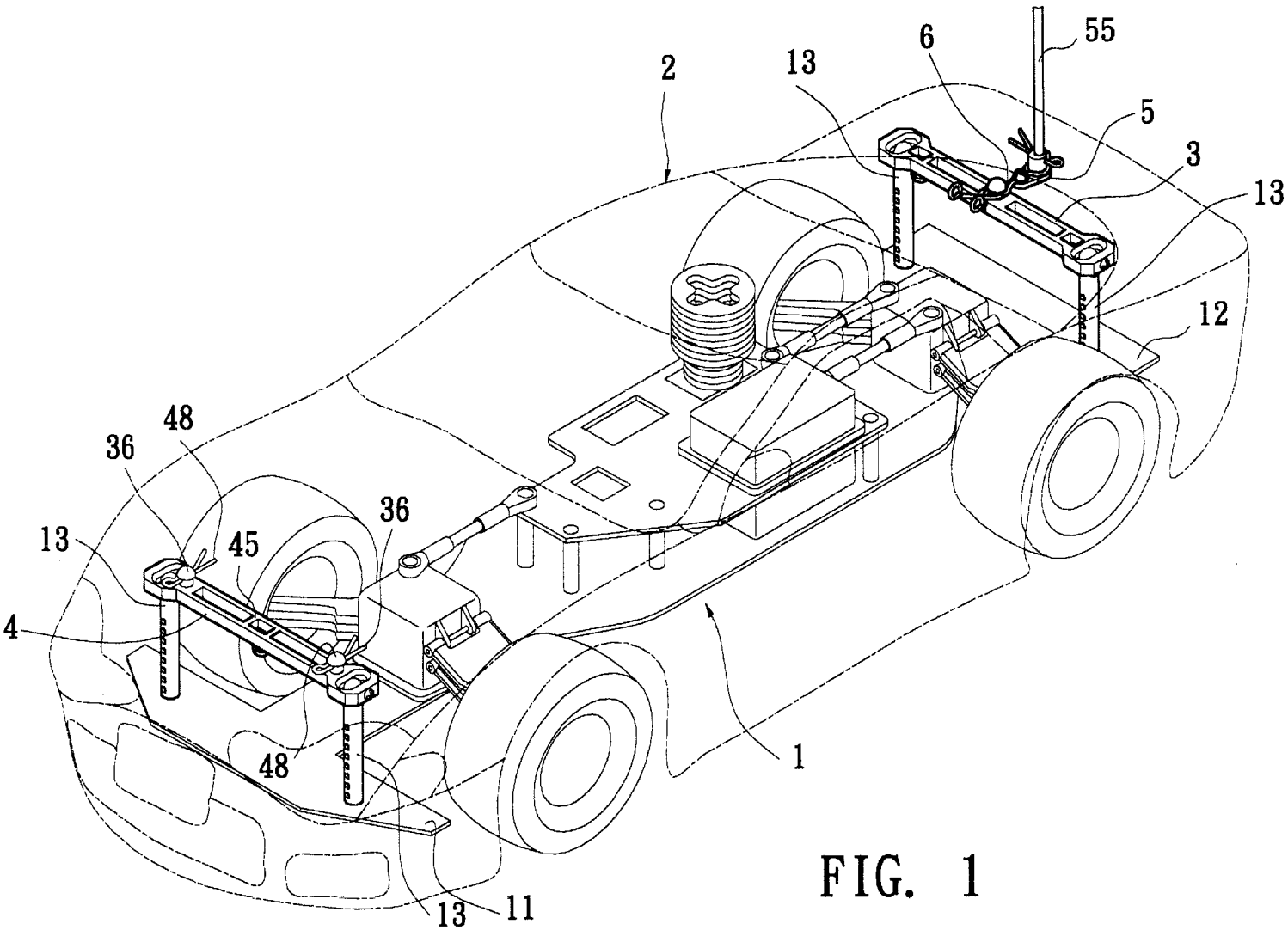
FIG. 1 is a perspective view of the structure of the present invention.
Figure 2:
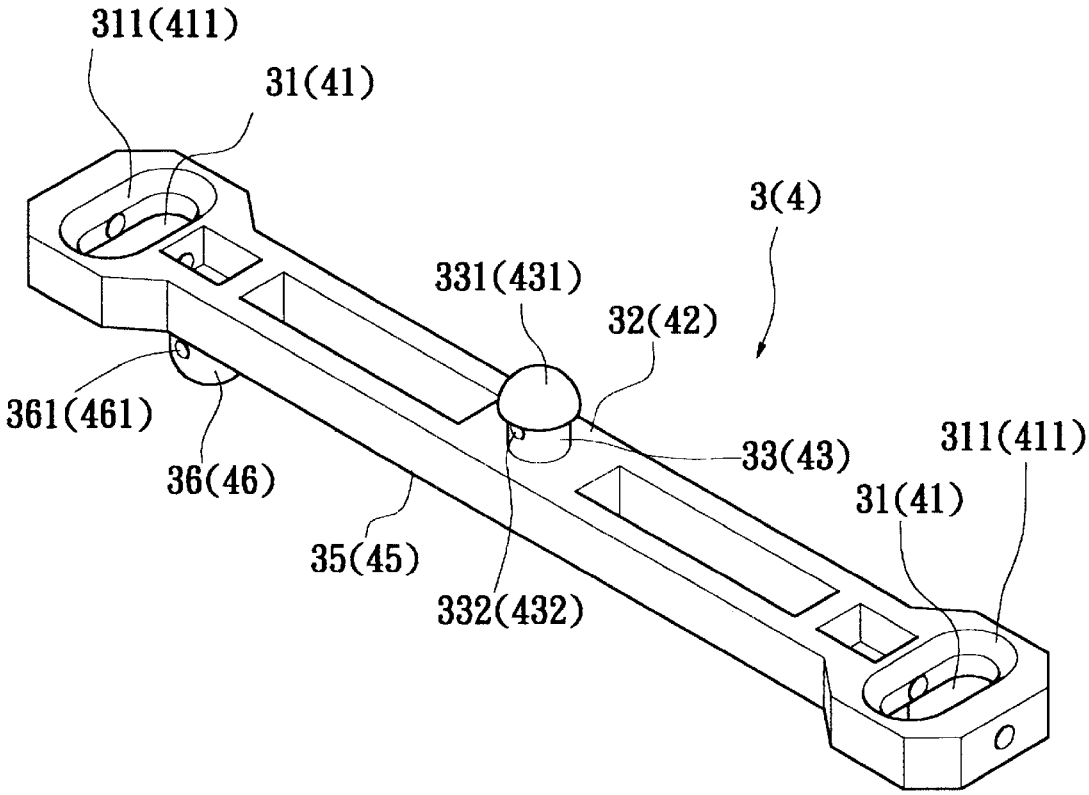
FIG. 2 is a perspective view of the fixing board of the present invention.
Figure 3:
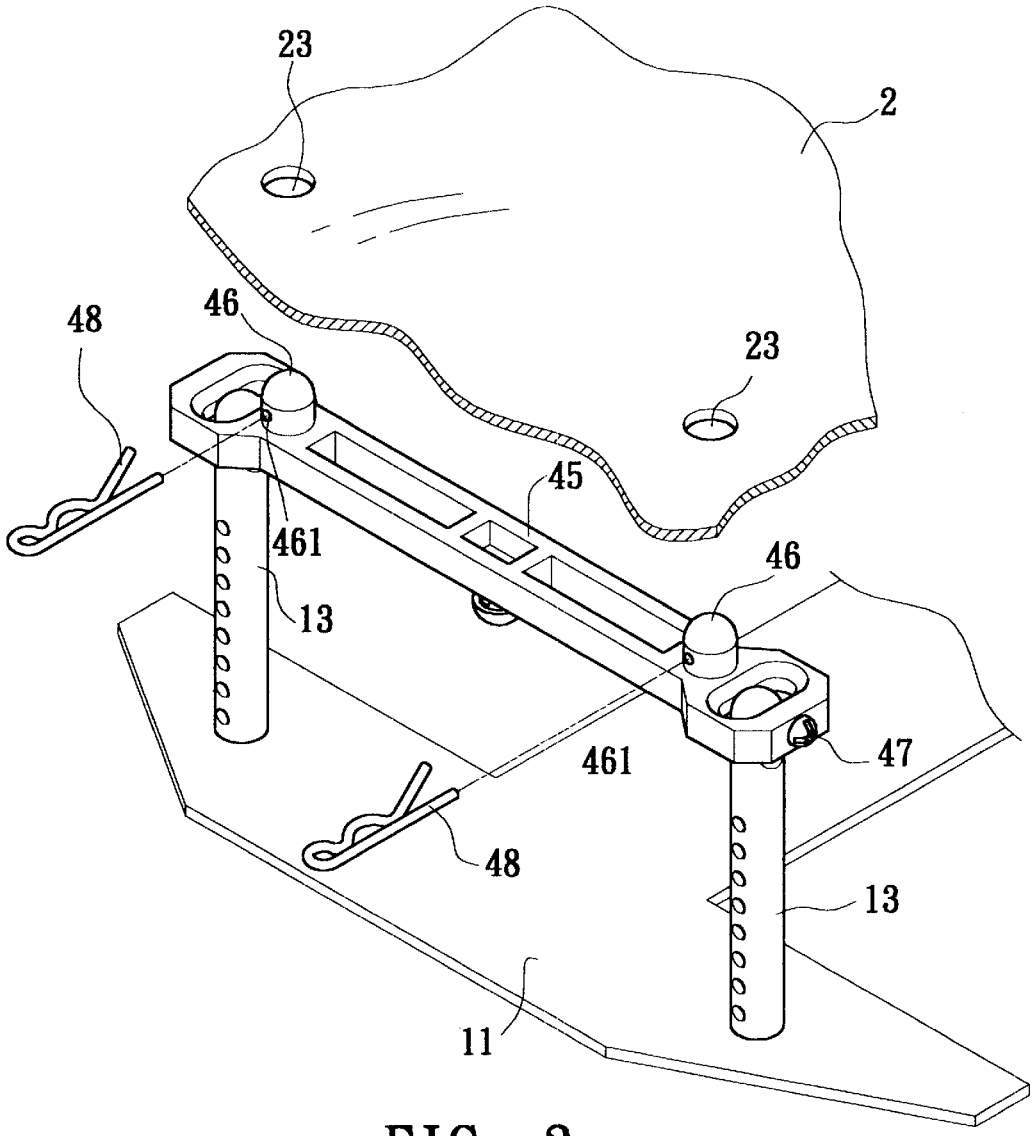
FIG. 3 is a perspective view showing that the fixing posts of front section of the car body are connected with the fixing board of the present invention.
Figure 4:
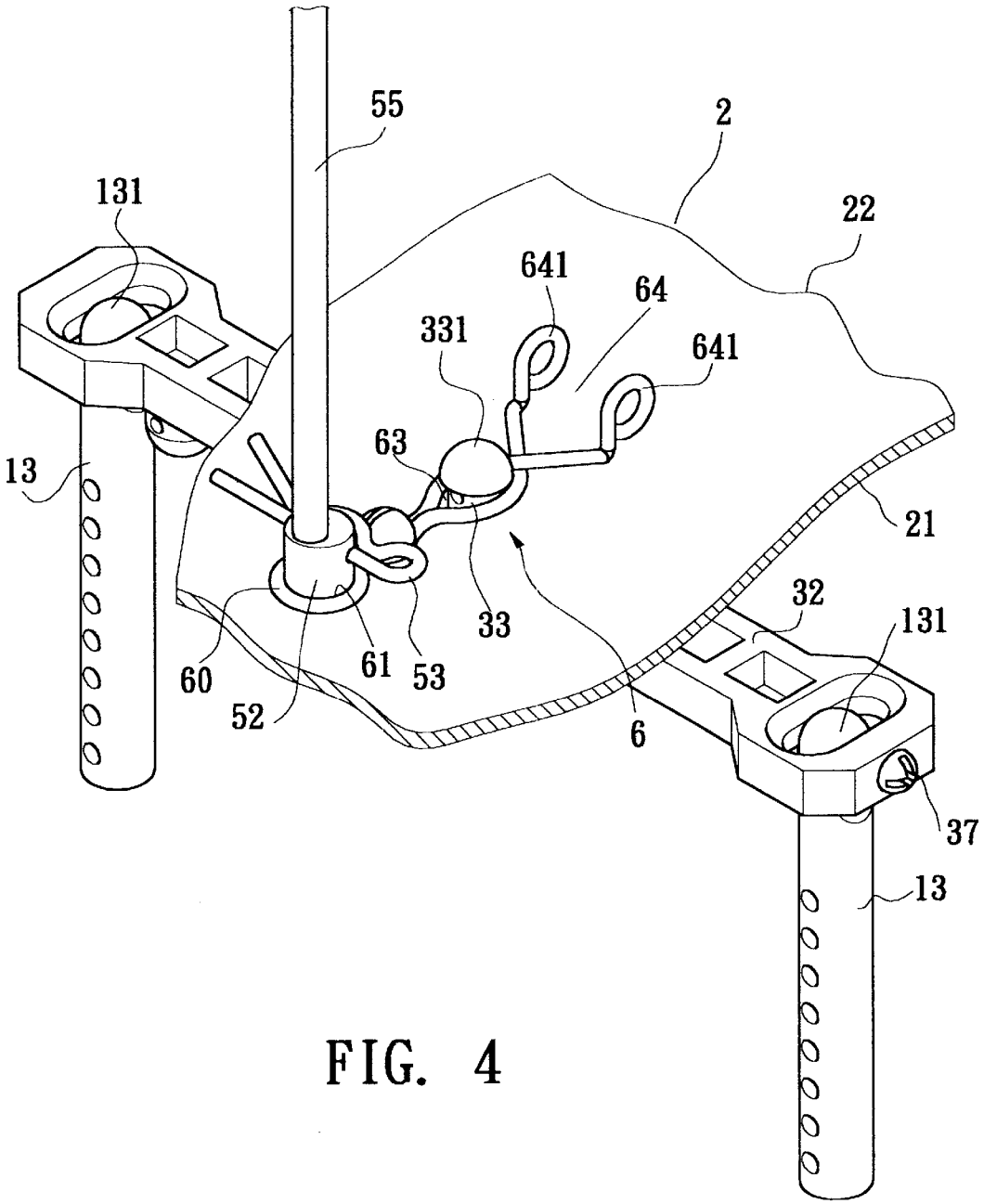
FIG. 4 is a perspective view showing that the fixing posts of rear section of the car body are connected with the fixing board of the present invention.
Figure 5:
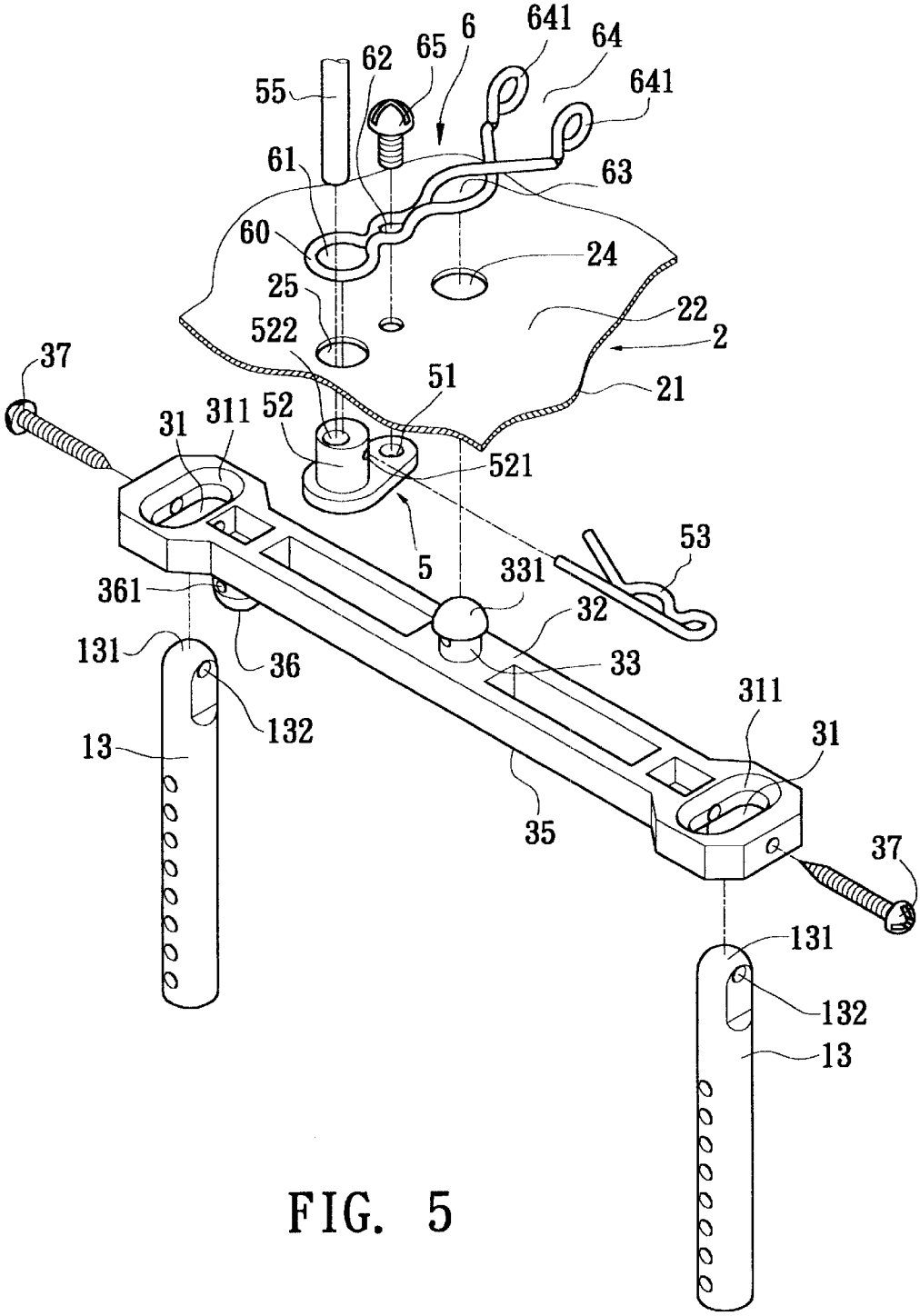
FIG. 5 is a perspective exploded view of the fixing posts and fixing board of the rear section of the car body of the present invention.

Please refer to FIGS. 1 to 7. The present invention includes a car body 1 covered by a car shell 2. A face of the car shell 2 proximal to the car body 1 is defined as an inner face 21. The other face of the car shell 2 opposite to the inner face 21 is defined as an outer face 22. According to the forwarding direction of the car body 1, the car body 1 has a front section 11 and a rear section 12 opposite to the front section 11. Two fixing posts 13 are respectively disposed on each of the front and rear sections 11, 12 for fixing the car shell 2. A top end 131 of each fixing post 13 distal from the car body 1 is formed with a through hole 132. The through holes 132 of the fixing posts 13 of the front and rear sections 11, 12 are coaxial.

The present invention further includes two fixing boards 3, 4 each of which is formed with two receiving holes 31, 41 corresponding to the fixing posts 13. The receiving holes 31, 41 are elliptic. A guide slope 311, 411 adjoins each receiving hole 31, 41 with the fixing board 3, 4. Each fixing board 3, 4 has a first abutting face 32, 42 and a column 33, 43 projecting from the first abutting face 32, 42. The column 33, 43 has an elliptic cross-section. One end of the column 33, 43 distal from the fixing board 3, 4 has a semispherical stop section 331, 431. The area of the cross-section of the stop section 331, 431 is larger than the area of the cross-section of the column 33, 43. In addition, the column 33, 43 is formed with an insertion hole 332, 432 radially passing through the column 33, 43.

Each fixing board 3, 4 has a second abutting face 35, 45 opposite to the first abutting face 32, 42. The second abutting face 35, 45 has two projecting bosses 36, 46 respectively adjacent to the receiving holes 31, 41. Each projecting boss 36, 46 is formed with a through hole 361, 461 radially passing through the projecting boss 36, 46.

In this embodiment, the fixing board 4 is connected with the two fixing posts 13 of the front section 11 of the car body 1 with the second abutting faces 45 facing upward. The two receiving holes 41 of the fixing board 4 are for the fixing posts 13 to pass therethrough. In addition, a bolt 47 is locked on the fixing board 4 and passed through the through hole of the fixing post 13, whereby the fixing board is pivotally connected with the fixing posts 13.

The car shell 2 is formed with two locating holes 23 respectively for the two projecting bosses 46 of the fixing board 4 to pass therethrough. The inner face 21 of the car shell 2 abuts against the second abutting face 45. An insertion pin 48 is inserted through the through hole 461 of the projecting boss 46 to fix the car shell 2.

The fixing board 3 is connected with the two fixing posts 13 of the rear section 12 of the car body 1 with the first abutting faces 32 facing upward. The two receiving holes 31 of the fixing board 3 are for the two fixing posts 13 to pass therethrough. In addition, a bolt 37 is locked on the fixing board 3 and passed through the through hole 132 of the fixing post 13, whereby the fixing board 3 is pivotally connected with the fixing posts 13.

The car shell 2 is formed with a through holes 24 corresponding to the stop section 331 of the fixing board 3. The stop section 331 and the column 33 of the fixing board 3 are passed through the through hole 24. The inner face 21 of the car shell 2 abuts against the first abutting face 32 of the fixing board 3.

The present invention further includes a seat body 5 having a certain area and attaching to the car shell 2 adjacent to the fixing board 3. The seat body 5 has a connecting hole 51 and a projecting block 52. The projecting block 52 has a substantially circular cross-section. The car shell 2 is formed with a hole 25 corresponding to the projecting block 52. The projecting block 52 passes through the hole 25 and protrudes from the outer face 22 of the car shell 2. The projecting block 52 is formed with an insertion hole 522 axially passing through the projecting block 52 and the seat body 5. A pole member 55 is inserted in the insertion hole 522. Practically, the pole member 55 can be a flagpole.

The present invention further includes a clip 6 integrally made of a wire body 60. The wire body 60 is continuously bent into several opposite semicircular portions forming a ring section 61, a fixing section 62 and a clip section 63 which are sequentially arranged. In addition, after bent to form the clip section 63, the wire body 60 further crossly extends. Two ends of the wire body 60 are curled into two loops 641 spaced from each other by a certain distance. The two loops 641 form a press section 64. When pressing the loops 641 of the press section 64 toward each other, the clip section 63 is stretched open.

A fixing bolt 65 is passed through the fixing section 62 and 25 the car shell 2 and screwed in the connecting hole 51 of the seat body 5, whereby the clip 6 and the seat body 5 are fixed on the car shell 2. The ring section 61 of the clip 6 is fitted on the projecting block 52 of the seat body 5. A portion of the projecting block 52 protruding from the ring section 61 is formed with a radial insertion hole 521. An insertion pin 53 is passed through the insertion hole 521 to fix the clip 6 with the car shell 2.

When the inner face 21 of the car shell 2 abuts against the first abutting face 32 of the fixing board 3, the clip section 63 of the clip 6 clips the column 33 of the fixing board 3. The stop section 331 of the column 33 stops the clip section 63 from detaching from the column 33 so as to fix the car shell 2 on the fixing board 3.

Figure 8:
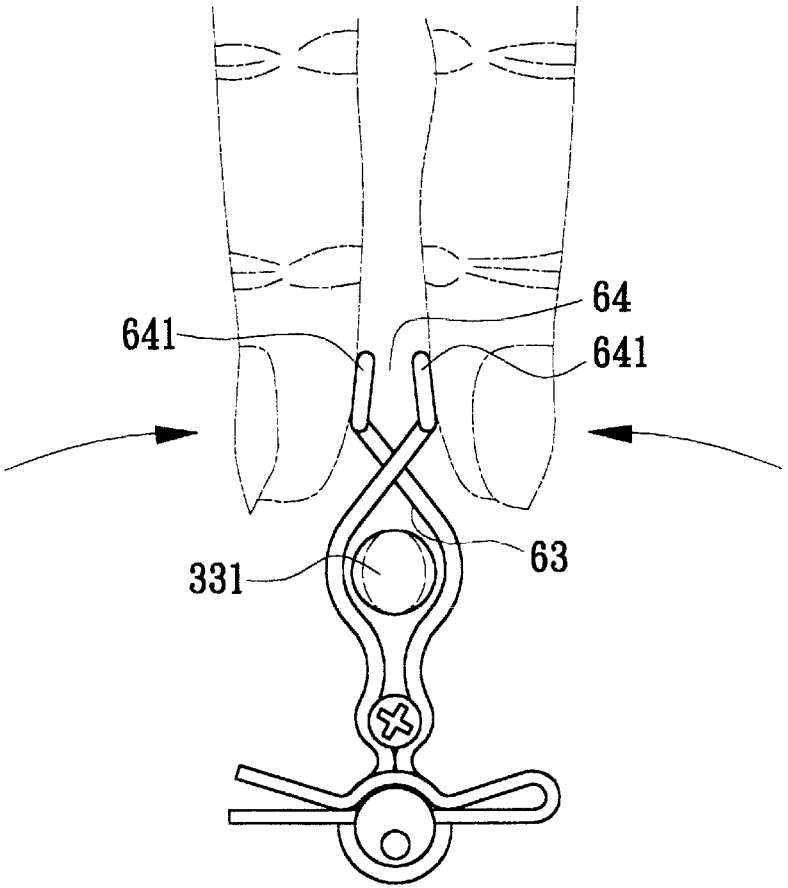
FIG. 8 shows that the press section of the clip of the present invention is compressed.
Figure 6:
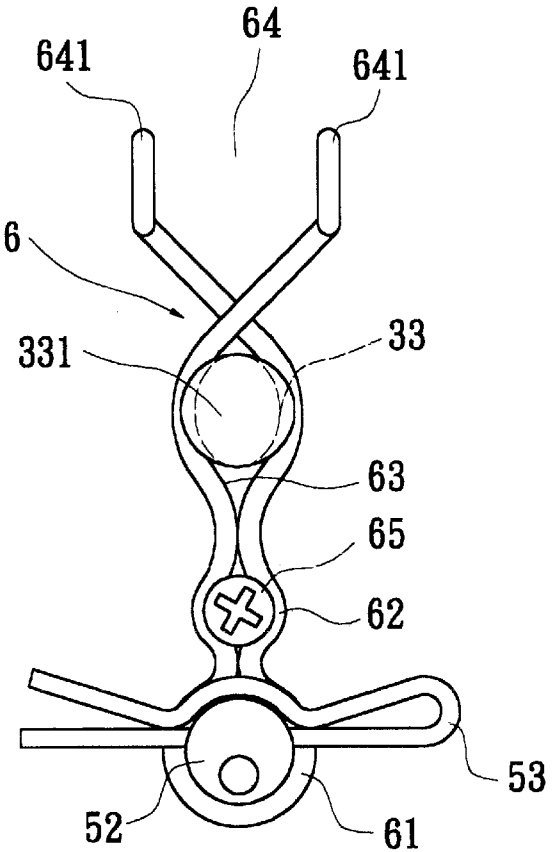
FIG. 6 is a plane view showing that the clip section of the clip clips the column of the fixing board of the present invention.
Figure 7:
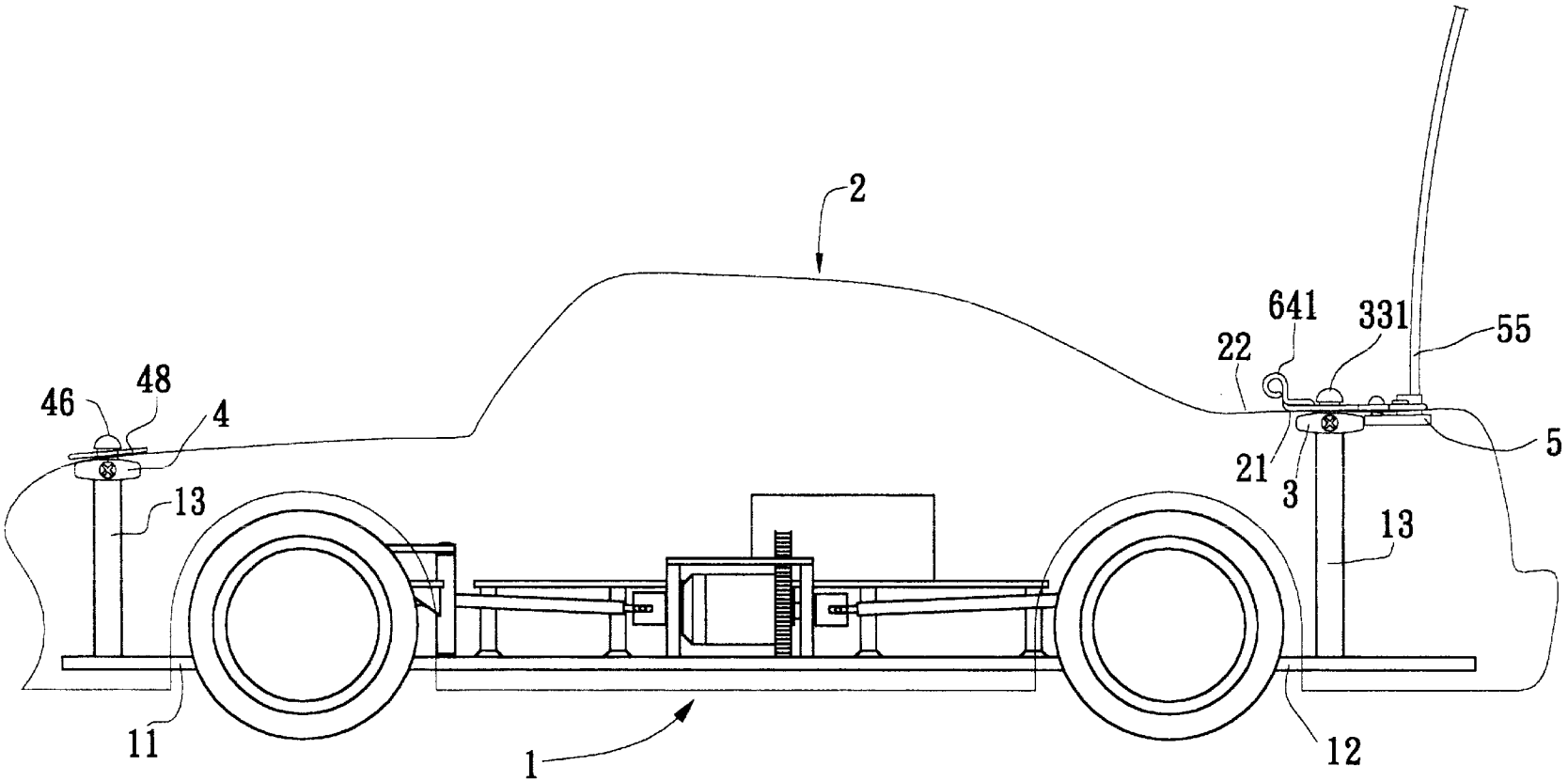
FIG. 7 shows that the car shell is fixed on the car body of the present invention.
Figure 9:
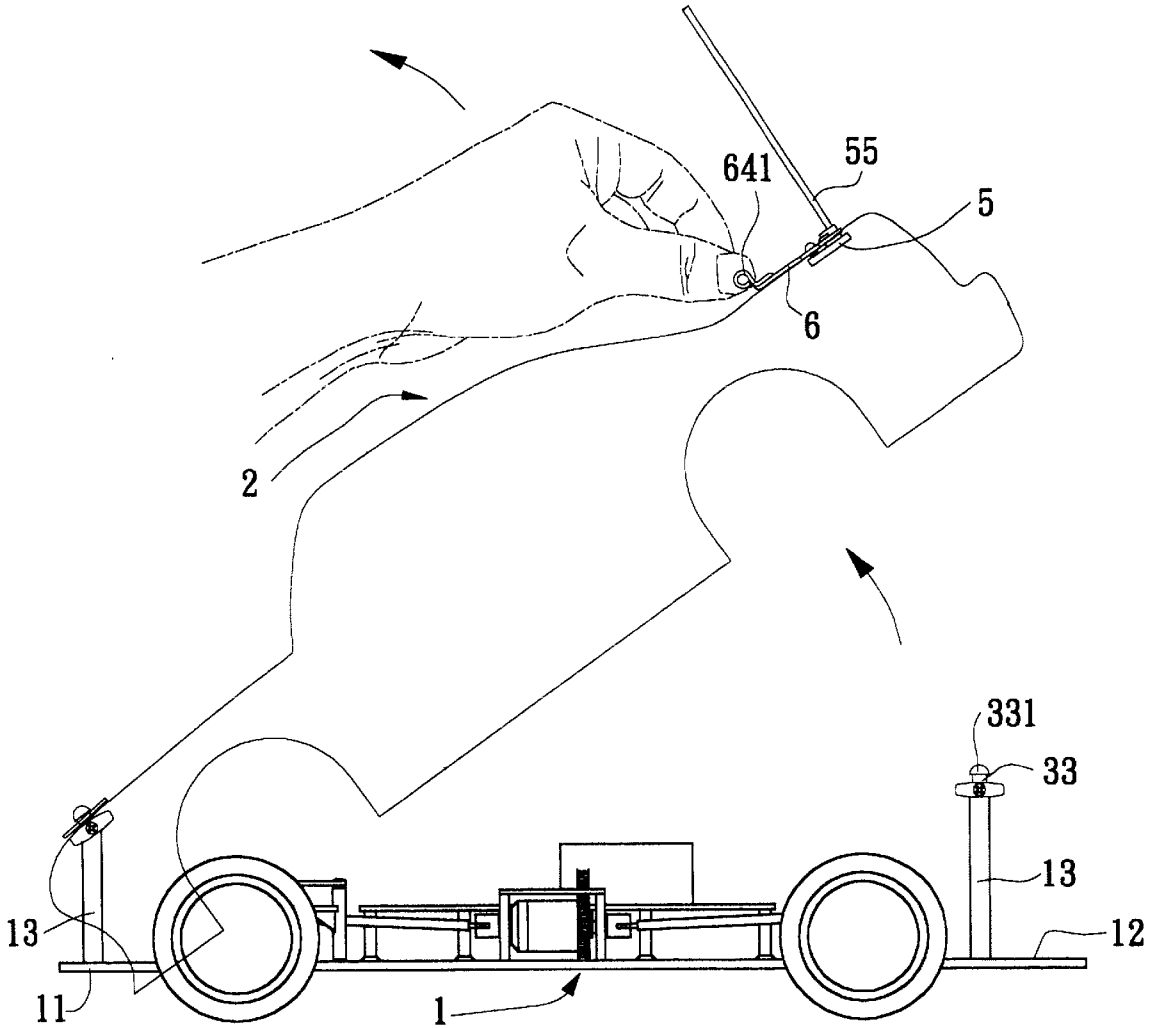
FIG. 9 shows that the car shell of the present invention is turned up.

When turning up the car shell 2, a user can forcedly press the two loops 641 of the press section 64 with fingers, making the two loops 641 move toward each other. At this time, the clip section 63 of the clip 6 will be stretched open to be larger than the stop section 331 as shown in FIG. 8. Under such circumstance, the clip 6 can be lifted to drive and turn up the car shell 2 about the pivoted section of the fixing board 4 and the fixing posts 13 of front section 11 of the car body 1. Accordingly, the car shell 2 can be quickly turned up as shown in FIG. 9.

When closing the car shell 2, the car shell 2 is pressed down to make the clip section 63 of the clip 6 abut against the stop section 331. Then the press section 64 is compressed to open the clip section 63 for passing through the stop section 331. Then the press section 64 is released, enabling the clip section 63 to clip the column 33. The stop section 331 stops the clip section 63 to fix the car shell 2 on the fixing board 3. Alternatively, after the clip section 63 abuts against the stop section 331, the clip 6 is forcedly pressed down. The stop section 331 is semispherical so that when pressing down the clip 6, the clip section 63 is stretched open by the stop section 331. Under such circumstance, the clip section 63 can pass through the stop section 331 to clip the column 33 so as to fix the car shell 2 on the fixing board 3.

It is apparent that it is quite convenient for a user to both turn 10 up the car shell 2 and close the car shell 2. The clip 6 is fixed on the car shell 2 without the problem of missing.

The first and second abutting faces 32, 35 of the fixing board 3 respectively have a column 33 and two projecting bosses 36 for fixing the car shell 2 in different manners. The components of the present invention are simplified and can be mass-produced to lower manufacturing cost.

The above embodiment is only used to illustrate the present invention, not intended to limit the scope thereof. Many modifications of the above embodiment can be made without departing from the spirit of the present invention. For example, with respect to a small-size car shell, the first abutting face of the fixing board of the front section of the car body can alternatively face upward. The column of the fixing board is fitted through the car shell and an insertion pin is inserted through the radial insertion hole of the column to fix the car shell on the fixing board. Alternatively, the two fixing boards of the front and rear sections of the car body in the first embodiment can be switched, whereby the car shell can be turned up from front side to rear side. This also achieves the same function as the first embodiment.

Figure 10:
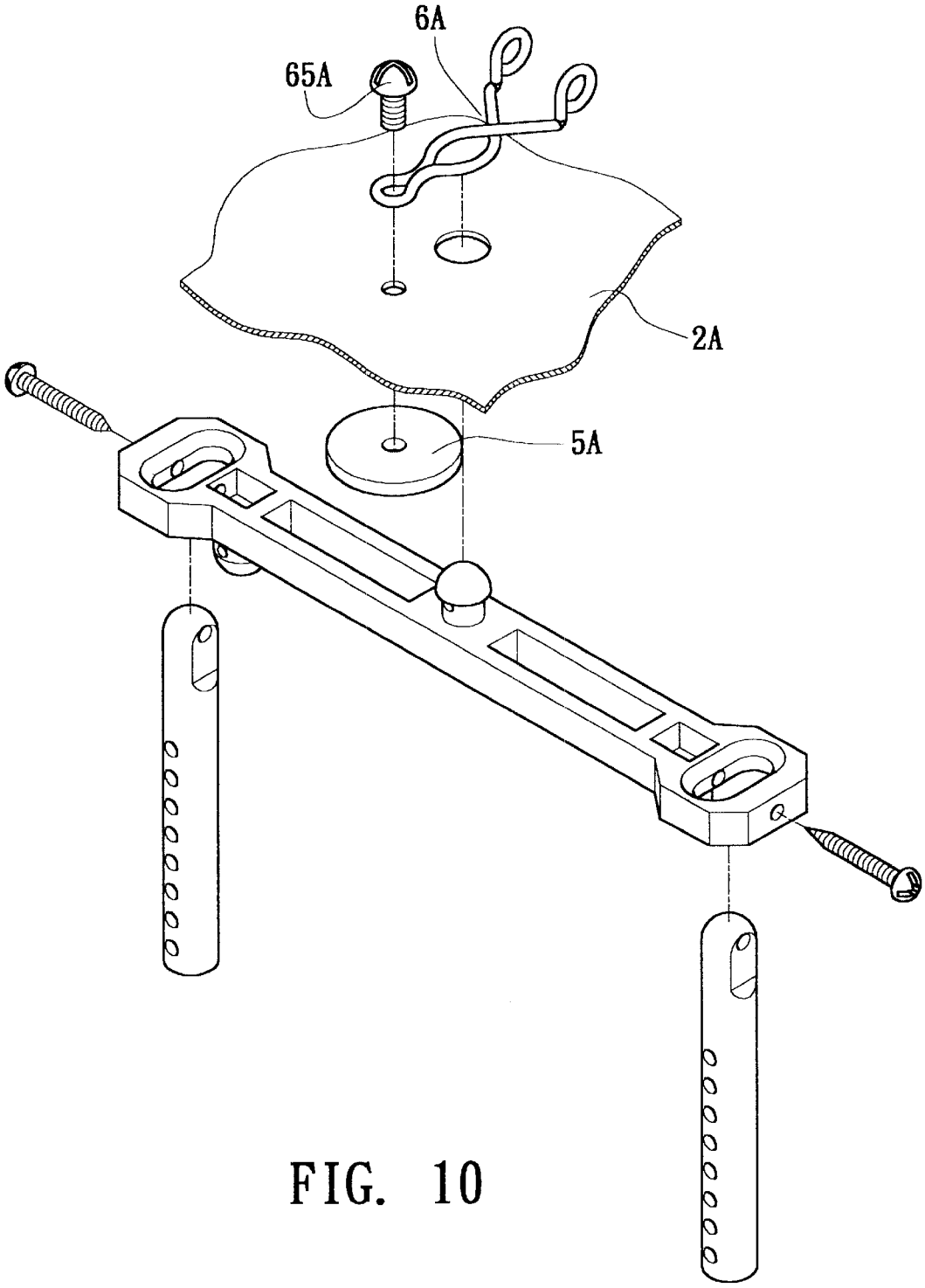
FIG. 10 is a perspective exploded view of a second embodiment of the present invention, in which the projecting block of the seat body and the ring section of the clip are emitted.
Figure 11:
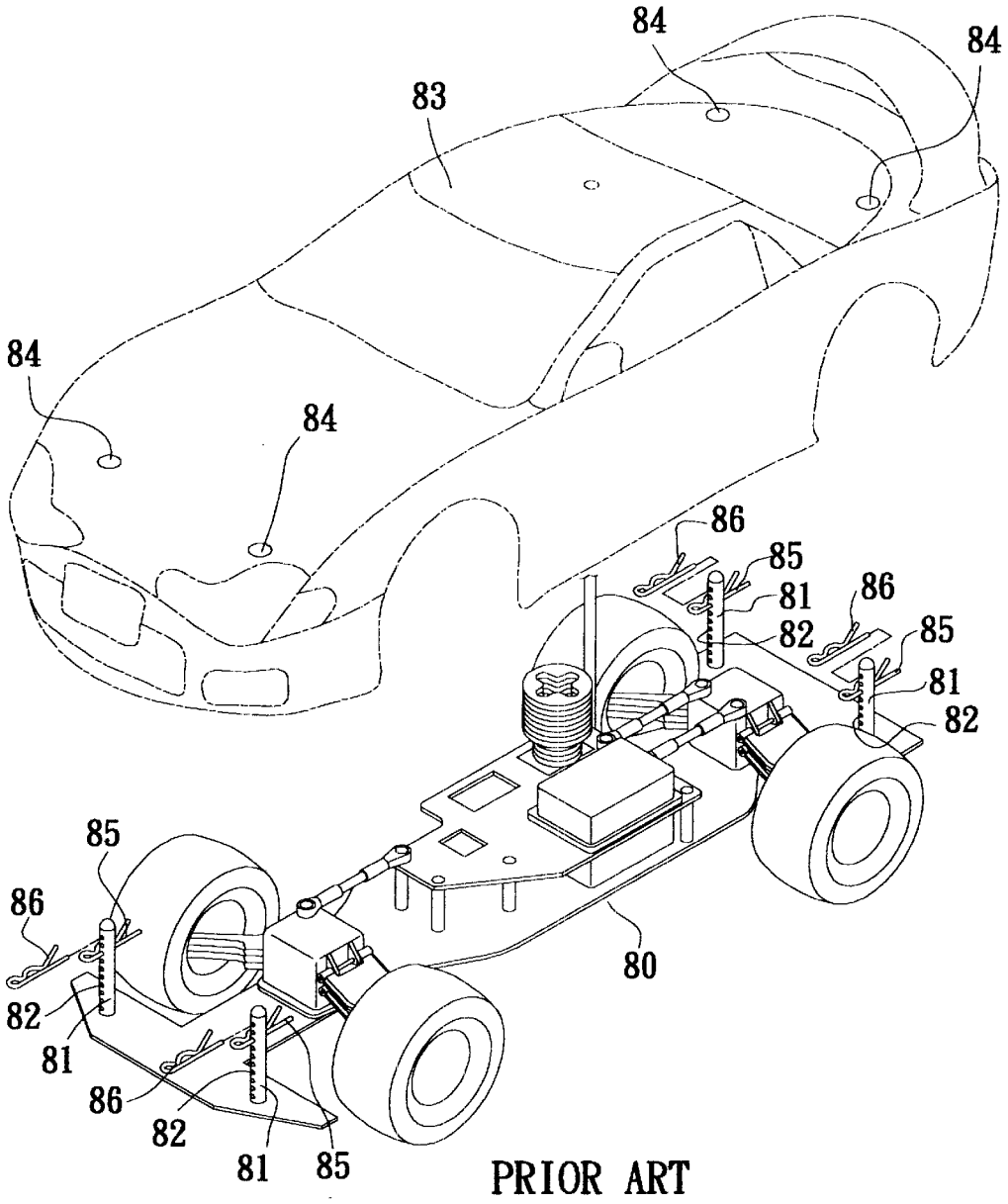
PRIOR ART FIG. 11
FIG. 11 shows the fixing structure for the car body and car shell of an existent remotely controllable car.
Figure 12:
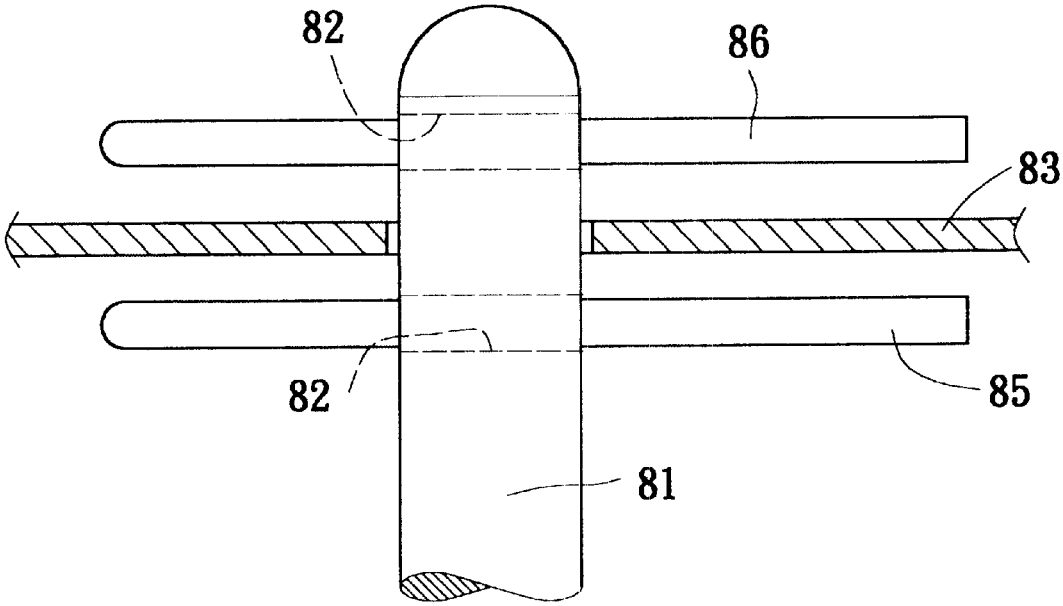
PRIOR ART FIG. 12
FIG. 12 shows the fixing structure for the car body and car shell of the existent remotely controllable car, in which the car shell is located by fixing insertion pins and locating insertion pins.

FIG. 10 shows a second embodiment of the present invention. In the case that the flagpole is unnecessary for the remotely controllable car, the projecting block of the seat body 5A can be omitted. Accordingly, it is unnecessary for the clip 6A to have a ring section. The seat body 5A and the clip 6A are locked on the car shell 2A simply by a fixing bolt 65A. This can also achieve the same function as the first embodiment.

What is claimed is:

1. A structure for quickly turning up a car shell of a remotely controllable car, comprising:

a car body covered by a car shell, a face of the car shell proximal to the car body being defined as an inner face, the other face of the car shell opposite to the inner face being defined as an outer face, according to a forwarding direction of the car body, the car body having a front section and a rear section opposite to the front section;

more than one fixing board fixed on front section or rear section of the car body, the fixing board having an abutting face, the fixing board being connected with the car body with the abutting face distal from the car body, a column projecting from the abutting face, one end of the column distal from the fixing board having a stop section, the area of the cross-section of the stop section being larger than the area of the cross-section of the column, the car shell being formed with a through hole corresponding to the stop section of the column of the fixing board, whereby the column and the stop section can be passed through the through hole, the inner face of the car shell abutting against the abutting face of the fixing board;

a seat body having a certain area and attaching to the car shell adjacent to the fixing board, the seat body having a connecting hole; and a clip integrally made of a wire body by bending, the clip having a fixing section, a clip section and a press section, whereby when forcedly compressing the press section, the clip section is stretched open, a fixing member being used to connect the fixing section with the fixing hole of the seat body, whereby the clip and the seat body are fixed on the car shell and the clip section of the clip clips a portion of the column of the fixing board, which protrudes from the car shell, the clip section being stopped by the stop section to fix the car shell on the fixing board.

2. The structure for quickly turning up car shell of a remotely controllable car as claimed in claim 1, wherein the seat body has a projecting block having a substantially circular cross-section, the car shell being formed with a hole corresponding to the projecting block, whereby the projecting block can pass through the hole and protrude from the outer face of the car shell, the fixing section of the clip further having a ring section fitted on the projecting block, a portion of the projecting block protruding from the ring section of the clip being formed with a radial insertion hole, whereby an insertion pin is passed through the insertion hole to fix the clip with the car shell.

3. The structure for quickly turning up car shell of a remotely controllable car as claimed in claim 1, wherein the fixing board has a second abutting face opposite to the abutting face, the second abutting face having two projecting bosses respectively adjacent to two receiving holes of the fixing board, each projecting boss being formed with a through hole radially passing through the projecting boss, the car shell being formed with two holes corresponding to the projecting bosses, whereby when the fixing board is connected with the car body with the second abutting face distal from the car body, the projecting bosses of the fixing board can pass through the holes of the car shell, an insertion pin being inserted through the through hole of the projecting boss to fix the car shell.

4. The structure for quickly turning up car shell of a remotely controllable car as claimed in claim 1, wherein the front or rear section of the car body is provided with two fixing posts for connecting with the fixing board.

5. The structure for quickly turning up car shell of a remotely controllable car as claimed in claim 4, wherein the fixing board is formed with two receiving holes respectively corresponding to the fixing posts, the receiving holes being elliptic, the fixing posts being passed through the receiving holes of the fixing board, at least a top end of each fixing post distal from the car body being formed with a through hole, the through holes of the two fixing posts of the front and rear sections of the car body being coaxial, a bolt being locked on the fixing board and passed through the through hole of the fixing post, whereby the fixing board is pivotally connected with the fixing posts.

6. The structure for quickly turning up car shell of a remotely controllable car as claimed in claim 4, wherein the receiving hole of the fixing board is adjoined with the fixing board via a guide slope.

7. The structure for quickly turning up car shell of a remotely controllable car as claimed in claim 1, wherein the column of the fixing board is formed with an insertion hole radially passing through the column for an insertion pin to insert therein.

8. The structure for quickly turning up car shell of a remotely controllable car as claimed in claim 1, wherein the column of the fixing board has an elliptic cross-section.

9. The structure for quickly turning up car shell of a remotely controllable car as claimed in claim 2, wherein the projecting block of the seat body is formed with an insertion hole axially passing through the projecting block and the seat body, whereby a pole member of the car body can be inserted in the insertion hole.

10. The structure for quickly turning up car shell of a remotely controllable car as claimed in claim 1, wherein the stop section of top end of the column of the fixing board is semicircular.

* * * * *